US005848172A

United States Patent [19]

Allen et al.

[11] Patent Number: 5,848,172

[45] Date of Patent: Dec. 8, 1998

[54] DIRECTIONAL MICROPHONE

[75] Inventors: Jonathan Brandon Allen, Mountainside, N.J.; John Charles Baumhauer, Jr., Indianapolis, Ind.; James Edward West, Plainfield, N.J.

[73] Assignee: Lucent Technologies Inc., Murray Hill, N.J.

[21] Appl. No.: 755,506

[22] Filed: Nov. 22, 1996

[51] Int. Cl.[6] ..... H04R 25/00

[52] U.S. Cl. ..... 381/356; 381/357; 381/358

[58] Field of Search ..... 381/155, 168, 381/169, 92, 58

[56] References Cited

U.S. PATENT DOCUMENTS 3,715,500 2/1973 Sessler et al. ..... 381/191
3,944,757 3/1976 Tsukamoto ..... 181/191
5,226,076 7/1993 Baumhauer, Jr. et al. ..... 381/92
5,511,130 4/1996 Bartlett et al. ..... 381/155

*Primary Examiner*—Sinh Tran

[57] ABSTRACT

A monolithic second order gradient (SOG) microphone structure employs acoustic transmission lines wherein the acoustic phase delay along each of the acoustic transmission lines is in direct proportion to the length of each of the acoustic transmission lines and, where this is effected by the use of an acoustic impedance element placed within each acoustic transmission line that has an acoustic impedance related to the acoustic impedance of the associated acoustic transmission line. In one embodiment, the acoustic impedance element has a specific acoustic impedance substantially matched to the specific acoustic characteristic resistance of the acoustic transmission line. Various embodiments may utilize acoustic or electrical subtraction of the signals in the acoustic transmission lines to realize the desired directional sound pickup.

19 Claims, 7 Drawing Sheets

500 Hz POLAR DIRECTIVITY

— — — ACOUSTIC IMPEDANCE DISC WITH 1 $\rho c$ SPECIFIC ACOUSTIC IMPEDANCE VALUE

——— ACOUSTIC IMPEDANCE DISC WITH 0.1 $\rho c$ SPECIFIC ACOUSTIC IMPEDANCE VALUE

------- ACOUSTIC IMPEDANCE DISC WITH 10 $\rho c$ SPECIFIC ACOUSTIC IMPEDANCE VALUE 2000 Hz POLAR DIRECTIVITY

SECTION A-A

DIRECTIONAL MICROPHONE

TECHNICAL FIELD

This invention relates to microphone assemblies and, more specifically, to a directional microphone assembly.

BACKGROUND OF THE INVENTION

In using telecommunication and multimedia terminals, background acoustic noise and acoustic reverberation are often major problems with regard to transmission sound quality. A long-standing solution to this problem is to use microphones with a directional sound pickup pattern. Second order gradient (SOG) microphones provide a more directional response than first order gradient microphones and are thus preferred. However, the SOG microphones are, in general, more difficult to assemble, are more expensive and are larger than desired.

FIG. 1 shows a prior known electrically obtained SOG microphone. It includes 4 omnidirectional microphones, namely P1, S1, S2 and P2, and electrical time delays $\tau$ and $\tau'$ and subtractions via algebraic summing units 101, 102 and 103 to yield the desired output at 104. Note that d1 is the distance between the centers of the dipoles formed by pairs P1, S1 and S2, P2, respectively, while d2 is the distance between P1 and S1, and S2 and P2. A problem with this approach is that it requires additional components which increase the cost, the size and the complexity of the microphone assembly.

Another approach to realize a SOG microphone is disclosed in U.S. Pat. No. 3,715,500, issued Feb. 6, 1973 to Sessler and West. and shown in FIG. 2. It should be understood that FIG. 2 can be readily derived from the arrangement shown in FIG. 1. In FIG. 2, it is implicitly assumed that the acoustic transmission lines do provide the time delays indicated, namely, $\tau$, $\tau'$ and $\tau+\tau'$. This was achieved by Sessler and West. by ensuring that acoustic transmission lines 201–204, having predetermined lengths L201–L204, respectively, entered the gradient-type electret microphone element into large summing chambers (+, −) on each side of the microphone diaphragm 205 to yield the desired output at 206. The high acoustic compliance of these summing chambers was used in an attempt to reduce the acoustic reflections and, thus, standing waves in the lines. In turn, this ensured that acoustic phase delays in the acoustic transmission lines 201–204 were approximately proportional to the length (L) of the particular acoustic transmission line. Because of the large summing chambers used in the Sessler and West. arrangement, the size of the resulting microphone assembly was large and, therefore, not well suited for use in small portable terminal devices. Additionally, the acoustic transmission lines employed in the Sessler and West. arrangement were discrete metal tubes which protruded from the microphone element, and this did not lend itself to low cost miniature fabrication. It should be noted that the gradient-type microphone element employed in the Sessler and West. arrangement employed a bidirectional or figure-of-eight polar directivity.

SUMMARY OF THE INVENTION

Problems and limitations of prior known second order gradient (SOG) microphone assemblies are overcome in a monolithic structure by employing acoustic transmission lines wherein the acoustic phase delay along each of the acoustic transmission lines is in direct proportion to the length of each of the acoustic transmission lines and, where this is effected by the use of an acoustic impedance element placed within each acoustic transmission line that has an acoustic impedance related to the acoustic impedance of the associated acoustic transmission line. In one embodiment, the acoustic impedance element has a specific acoustic impedance substantially matched to the specific acoustic characteristic resistance of the acoustic transmission line. In a specific embodiment of the invention, by positioning the acoustic impedance elements at the input ports of the acoustic transmission lines. Various embodiments may utilize acoustic or electrical subtraction of the signals in the acoustic transmission lines to realize the desired directional sound pickup.

DETAILED DESCRIPTION

Figure 3:
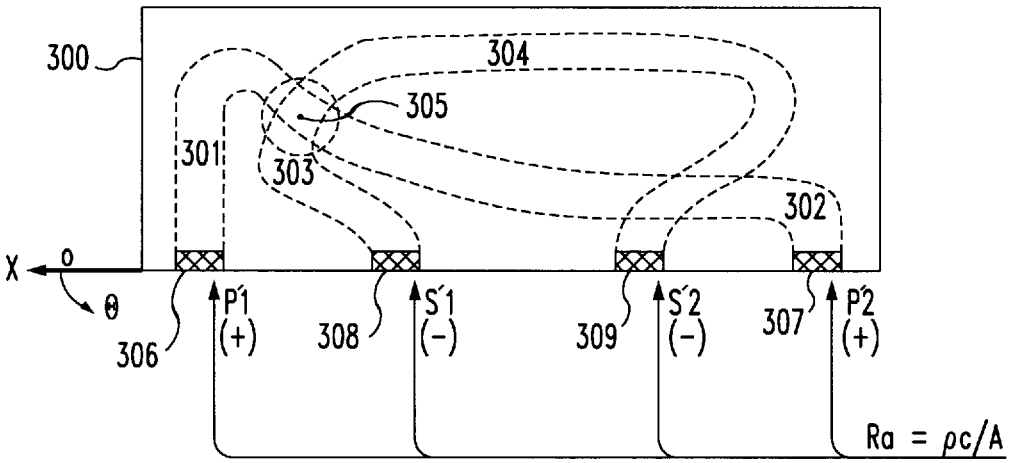
FIG. 3 shows a top view of a SOG microphone assembly employing an embodiment of the invention.

FIG. 3 shows a top view of a monolithic microphone assembly 300 utilizing a plurality of acoustic transmission lines, i.e. for example, plastic tubing, 301–304 for coupling the acoustic signal from acoustic input ports P'1, S'1, S'2, P'2 to first order gradient-type bidirectional microphone element 305, which is for example, a first order gradient type bidirectional microphone element. Microphone element 305 may be, for example, an electrect microphone element. The desired acoustic delays of acoustic transmission lines 301–304, having predetermined lengths L301–L304, respectively, are realized in accordance with the invention by employing acoustic impedance elements 306–309 in the respective acoustic transmission lines 301–304. In order that the acoustic phase delay along the acoustic transmission lines be in proportion to their length, L, as desired, the specific acoustic impedance of the acoustic impedance elements is chosen to match the specific acoustic characteristic impedance of the acoustic transmission lines, namely, $\rho c$, where c and $\rho$ are the wave speed of sound in, and the density of air, respectively. Thus, the acoustic impedance of the impedance elements is $Ra=\rho c/A$, where A is the cross section area of the acoustic transmission lines. Herein, we have assumed that the fluid viscosity on the acoustic transmission line walls is relatively small and, thus, the specific acoustic characteristic impedance of each of the acoustic transmission lines is approximated by its specific acoustic characteristic resistance, $\rho c$. Thus, since the specific acoustic impedance of the acoustic impedance elements 306–309 is real, they become specific acoustic resistance elements.

Figure 4:
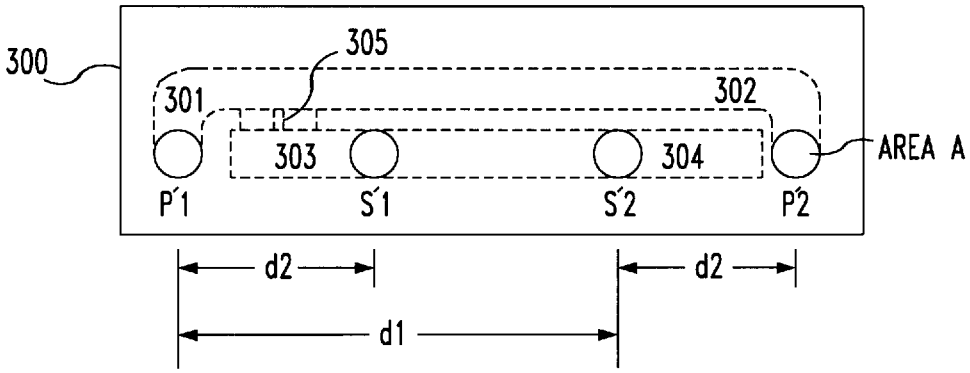
FIG. 4 shows a front view of the microphone assembly of FIG. 3.

FIG. 4 is a front view of microphone assembly 300 illustrating the spatial relationship of the acoustic input ports P'1, S'1, S'2, P'2 and the relationship of acoustic transmission lines 301–304 to microphone element 305. Note that microphone element 305 can be unidirectional first order gradient microphone element or a bidirectional first order gradient microphone element. It should be noted that as shown in FIG. 4, the acoustic input ports of acoustic transmission lines 301–304 are in a straight line, i.e., they are in a colinear alignment with each other. It should also be noted that the required subtractions to realize a SOG microphone assembly are obtained acoustically by supplying the sound from ports P'1 and P'2 to one side of microphone element 305 and sound from ports S'1 and S'2 to the other side of microphone element 305.

Since in the embodiment shown in FIGS. 3 and 4, the acoustic phase change along a length of the acoustic transmission lines 301–304, for example length x, is given by $\phi=-kx=-(\omega/c)x$, where k is the wave number and $\omega=2\pi f$, the frequency in radians/second, then, the group delay is $-\partial\phi/\partial\omega=x/c\equiv\tau$ seconds. This result owes to our use of the acoustic impedance elements 306–309 which are matched to the specific acoustic characteristic impedance of their associated acoustic transmission lines 301–304, respectively, and allows for the selection of appropriate acoustic transmission line lengths L as indicated in the example below. First distances d1 and d2 where (d2<d1), as well as one of the acoustic transmission line lengths, for example L303, may be arbitrarily selected. It is noted that longer distances d1 and d2 will result in higher output sensitivity, but lower high frequency bandwidth. Then, a selection of the type of polar directivity desired prescribes relationships $\tau$ (d1, d2) and $\tau'$ (d1, d2). [See for example, H. F. Olson, *Acoustical Engineering,* D. Van Nostrand Company, Inc., 1957, and J. E. West, G. M. Sessler and R. A. Kubli, "Unidirectional, Second-Order-Gradient Microphone," J. Acoust. Soc. Am., Vol. 86, pg. 2063–2066 (1989)]. Finally, the other three acoustic transmission lines lengths L301, 302 and 304 are determined from the group delay relationships noted above. Consider the example of a hypercardioid SOG structure, ideally having a directivity index (DI) of 9.5 dB—the highest possible for a SOG microphone assembly. Then, choose d1=0.023 meters, d2=0.015 meters and L303=0.022 meters. To form the desired hypercardioid SOG microphone assembly, $\tau=0.695\ d1/c=46\ \mu s$, and $\tau'=-0.291\ d2/c=-13\ \mu s$, where c=345 m/s. Then, following FIGS. 2 and 3, L301=L303$-\tau'c$=0.026 m, L302=L303$+\tau c$=0.038 m and L304=L303$+(\tau-\tau')c$=0.042m. It may be noted that since $\tau'$ is negative, $\tau'$ was subtracted from all four of the acoustic transmission line lengths in order to make the acoustic transmission lines physically realizable.

It should be further noted that input ports S'1 and S'2 and the associated acoustic transmission lines 303 and 304 could be merged into a single input port and acoustic transmission line. But, this would result in some loss in generality since then d1≡d2. This would restrict the variety of directional polar responses that could be achieved with the inventive SOG microphone assembly. It would, however, result in some simplicity of construction. Additionally, the specific acoustic characteristic resistance elements do not need to be necessarily placed at the inlets of the acoustic transmission lines. Indeed, they can be placed at any position in the acoustic transmission lines, even at the microphone element. Data indicates that the polar directivity patterns will not be altered, but that the frequency response will undergo significant response (linear) distortion. Placement of the specific acoustic characteristic resistance elements seems then to effect the amplitude but not relative phases of the various acoustic transmission line signals. Therefore, it is preferred to place the specific acoustic characteristic resistance elements 306–309 at the port locations as shown in FIG. 3. Moreover, it should be further noted that the cross section of the acoustic transmission lines does not have to be circular as depicted herein. The cross section can be rectangular, triangular, or the like without any fundamental change. Of course, the acoustic impedance elements must be matched to the acoustic transmission lines cross section.

Figure 5:
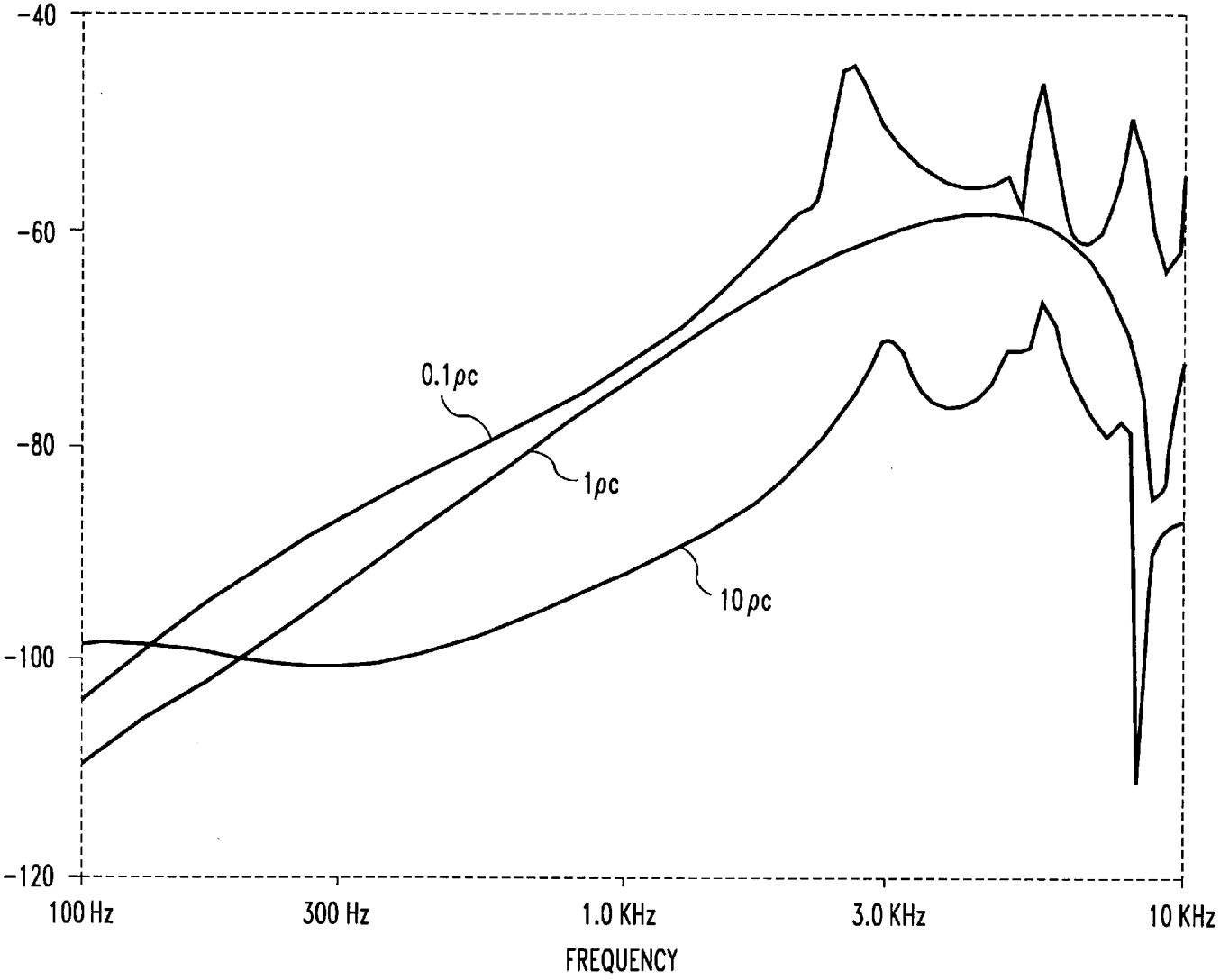
FIG. 5 graphically illustrates the frequency response of a microphone assembly similar to that shown in FIGS. 3 and 4 including varied acoustic impedance elements.

FIG. 5 shows frequency responses of the inventive microphone assembly including acoustic resistance elements having different values of specific acoustic resistance. Shown is the output electro-acoustic sensitivity versus frequency employing acoustic resistance elements properly matched to the acoustic transmission lines, namely, 1 $\rho c$, and for two different levels of specific acoustic resistance that is not properly matched to the acoustic impedance of the acoustic transmission line, namely, 0.1 $\rho c$ and 10 $\rho c$. One skilled in the art would note that the 1 $\rho c$ response is that which is typically expected of a second order gradient (SOG) microphone. Therefore, the use of the acoustic impedance elements is indeed successful in making the time delays proportional to the lengths of the acoustic transmission lines. This simulation utilizes the dimensions d1 and d2 and the L from the prior example. The frequency response is for a sound source along the positive X axis, i.e., $\theta=0$, shown in FIG. 3, and located at a distance of two (2) meters from the center of the structure located between ports S'l and S'2. In this example, the diameters of the acoustic transmission lines were 4.06 mm.

Figure 6:
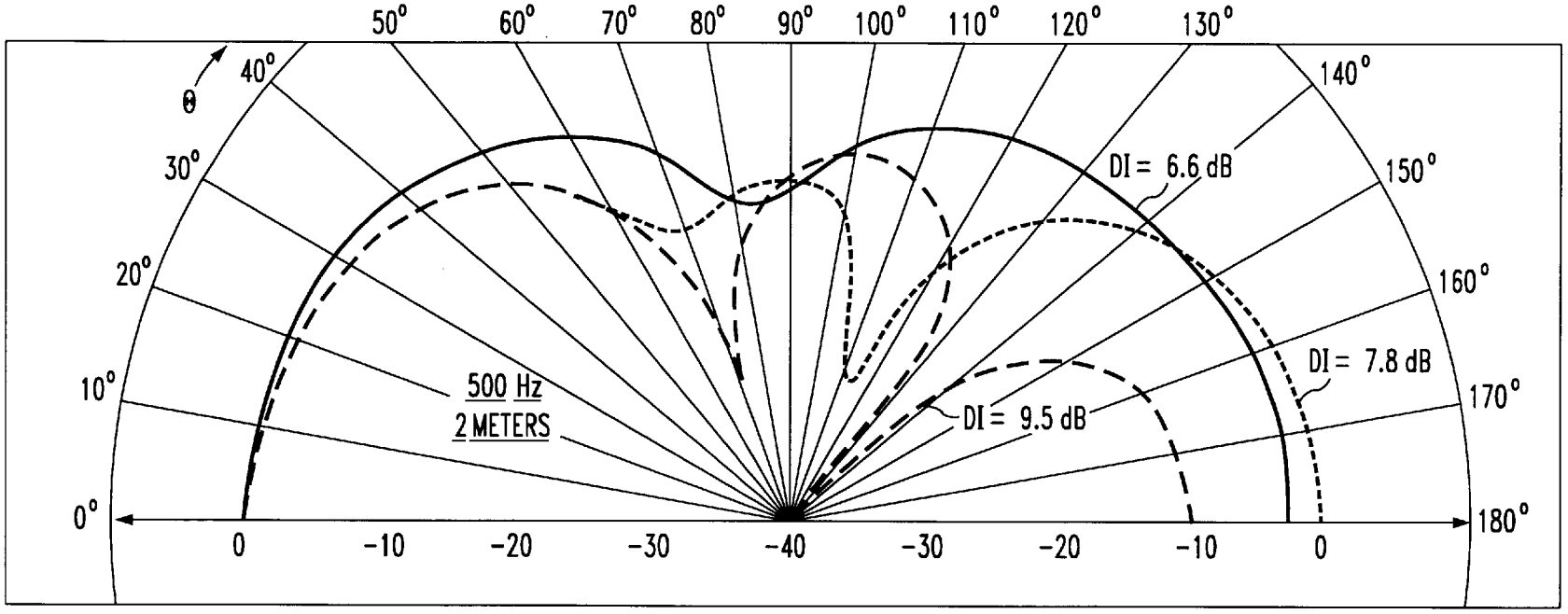
FIG. 6 graphically illustrates the directional polar response at a first predetermined frequency and corresponding to the frequency responses shown in FIG. 5 for a microphone assembly including varied acoustic impedance elements.

FIG. 6 is a directional polar response for the inventive microphone assembly including different values of specific acoustic impedance placed in the acoustic transmission lines. Again, the values 0.1 $\rho c$, 1 $\rho c$ and 10 $\rho c$ are depicted for a frequency of 500 Hz and for a sound source at a distance of 2 meters from the center position located between ports S'1 and S'2. The directional polar response curves are relative in that the levels are all normalized to zero dB at zero degrees, which is, generally, the position of the talker. One skilled in the art of SOG microphones can see that the 1 $\rho c$ curve is the expected hypercardioid directional polar pattern. It may be seen that when an improper (unmatched) level of specific acoustic impedance is utilized for the acoustic impedance elements such as 10 $\rho c$, or 0.1 $\rho c$, then the directivity index does not achieve that which is to be expected of a hypercardioid SOG microphone, i.e., DI=9.5 dB.

Figure 7:
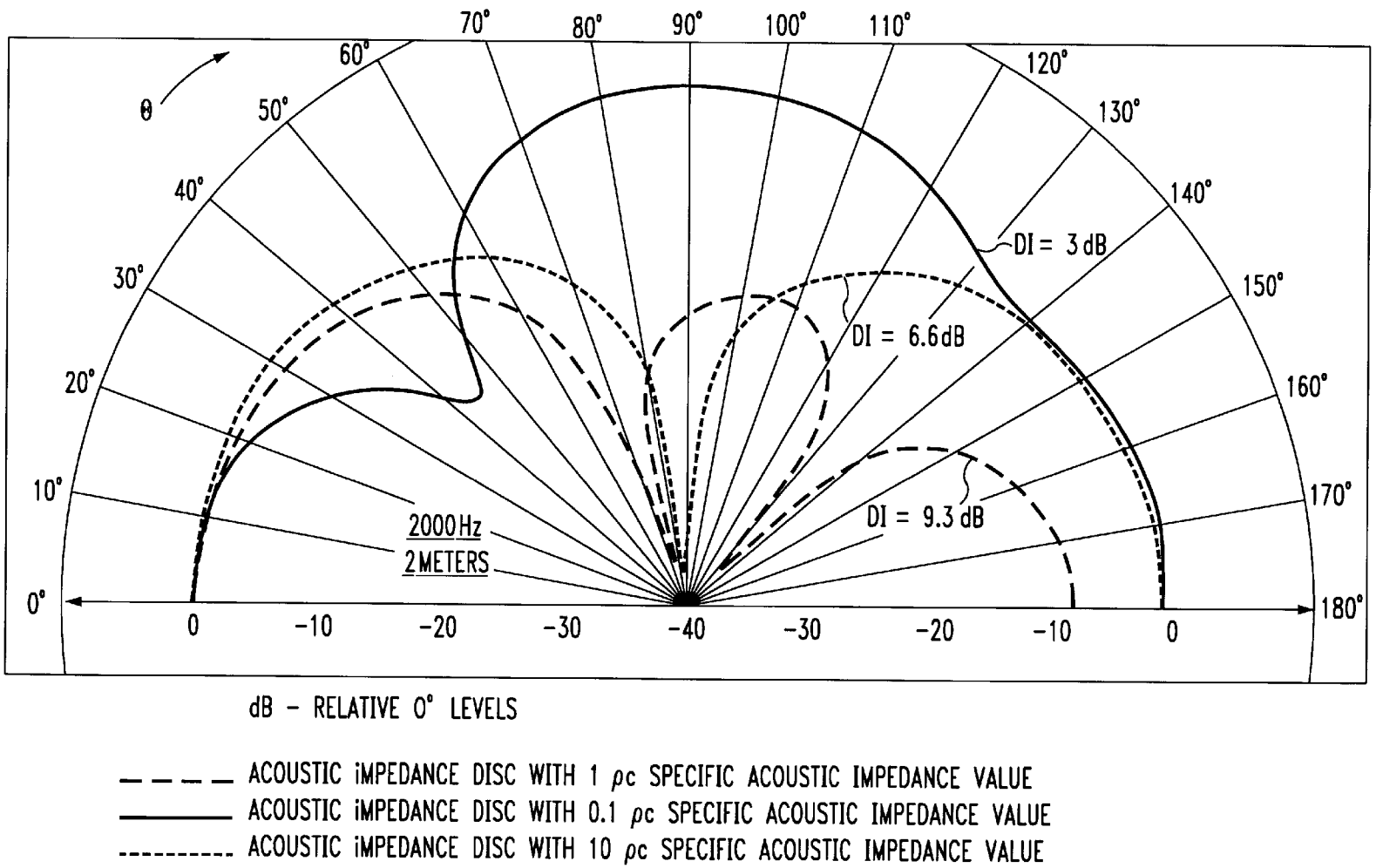
FIG. 7 graphically illustrates the directional polar response at a second predetermined frequency and corresponding to the frequency responses shown in FIG. 5 for a microphone assembly including varied acoustic impedance elements.

FIG. 7 is a directional polar response for the inventive microphone assembly including different values of specific acoustic impedance placed in the acoustic transmission lines. Again, the values 0.1 ρc, 1 ρc and 10 ρc are depicted for a frequency of 2000 Hz and for a sound source at a distance of 2 meters from the center position located between ports S'1 and S'2. The directional polar response curves are relative in that the levels are all normalized to zero dB at zero degrees, which is, generally, the position of the talker. One skilled in the art of SOG microphones can see that the 1 ρc curve is the expected hypercardioid directional polar pattern. It may be seen that when an improper (unmatched) level of specific acoustic impedance is utilized for the acoustic impedance elements such as 10 ρc, or 0 ρc, then the directivity index does not achieve that which is to be expected of a hypercardioid SOG, i.e., DI=9.5 dB.

The acoustic resistance elements may be provided by cloth screens, sintered metal disks or open-cell foam disks. These materials are structurally continuous in nature and are characterized by a specific acoustic resistance, which resistance is matched to the specific acoustic characteristic resistance of the acoustic transmission line (being continuous in nature, these materials ideally distribute the acoustic resistance evenly across the port cross section areas). Again, it should be noted that the proper matching specific acoustic resistance is 1 ρc for the acoustic transmission line.

Figure 8:
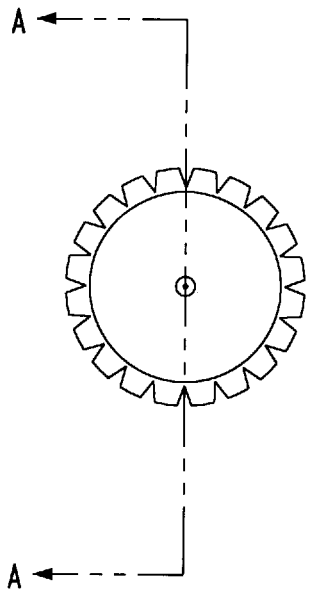
FIG. 8 shows a top view of one embodiment of an acoustic impedance element that may be employed in practicing the invention.
Figure 9:
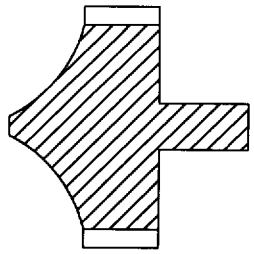
FIG. 9 shows a side view of the acoustic impedance element of FIG. 8.

FIG. 8 shows a top view of another example of an acoustic resistance element that may be employed in practicing the invention, while FIG. 9 shows a cross-section of the acoustic resistance element. Section A—A in FIG. 9 shows that the sound arrival is from the right side. This approach uses more of a lumped element as opposed to a continuous approach for providing the acoustic resistance necessary for the acoustic resistance element. Namely, a large number of very small, in this case, triangular holes, are utilized to provide acoustic resistance and yet very low acoustic mass. It has been shown by our simulated data that if the acoustic impedance elements contain acoustic mass reactance that the acoustic mass in combination with the acoustic transmission line acoustic compliance will yield an acoustic resonance that is deleterious to the resulting SOG microphone assembly. Specifically, the frequency response at higher frequencies becomes irregular and the directivity indices associated with the directional polar response curves are deteriorated, i.e., lowered. It should be noted that by using the large number of very small holes the acoustic mass to acoustic resistance ratio is minimized.

Figure 10:
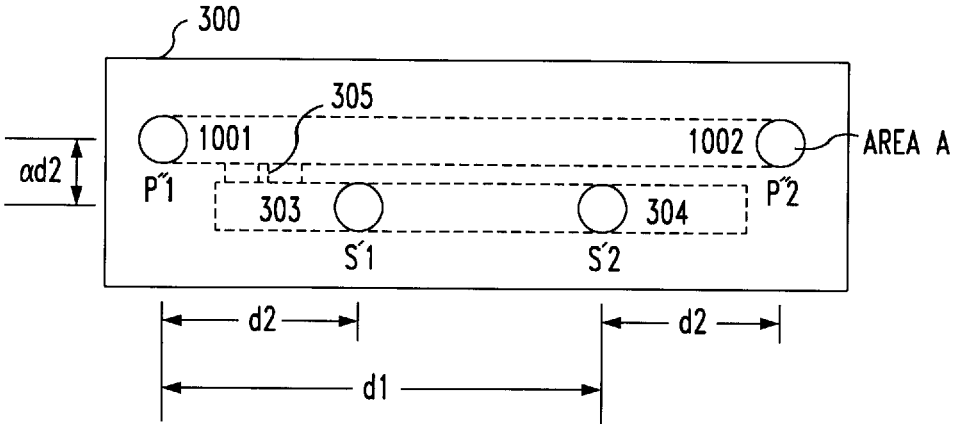
FIG. 10 shows a front view of another embodiment of a microphone assembly similar to that depicted in FIG. 4.

FIG. 10 shows a front view of another microphone assembly similar to that depicted in FIG. 4. In some applications, the near field polar directivity pattern for the microphone assembly may become critical. In the arrangement shown in FIG. 10, the two outer acoustic input ports P"1 and P"2 which are interconnected by lines 1001 and 1002 are offset from the original alignment of the acoustic input ports P'1, S'1, S'2 and P'2 shown in FIG. 4 by a value $\alpha$ d2, where $\alpha$ is a dimensionless constant less than unity. The acoustic input ports P"1, S'l, S'2 and P"2, as shown in FIG. 10, appear along an arc of a circle. This SOG microphone assembly can be advantageous to create a better null in the near-field polar directivity pattern toward a nearby loudspeaker being placed in the terminal apparatus for two-way communication. This, as will be apparent to those skilled in the art, minimizes loudspeaker-to-microphone coupling. It should be further noted that because of the change in the positioning of acoustic input ports P"1 and P"2, the corresponding positioning of transmission lines 1001 and 1002 need to be adjusted to retain the desired lengths. The other elements of the embodiment shown in FIG. 10 have been labeled in similar fashion to the corresponding elements in FIG. 4.

Figure 11:
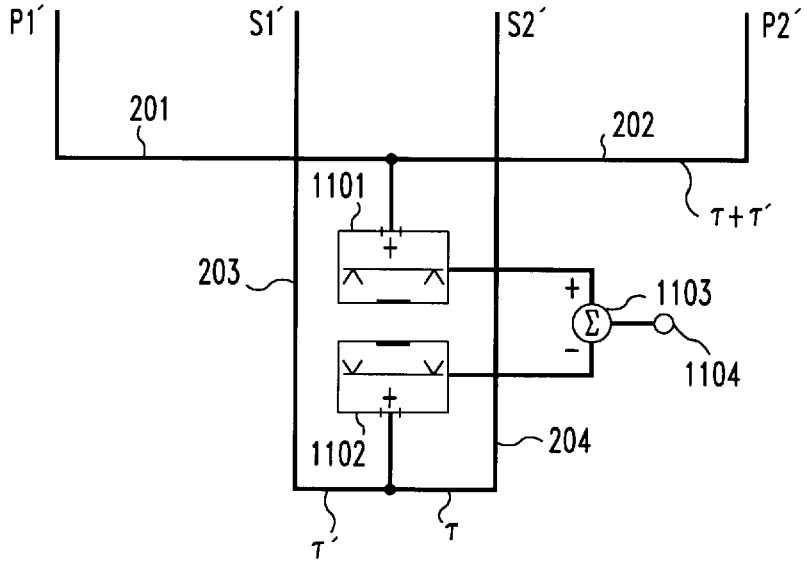
FIG. 11 shows a SOG microphone assembly also employing an embodiment of the invention.

FIG. 11 shows another embodiment of the invention that employs 2 identical omnidirectional microphone elements 1101 and 1102, the outputs of which are in turn seem to be subtracted via algebraic combining unit 1103 to yield the microphone output at 1104. Consequently, it is clear that functionally, the arrangement shown in FIG. 11 achieves the same result as the arrangement showed in FIG. 2 owing to the fact that an acoustic subtraction across the microphone elements diaphragm has been replaced by an electrical subtraction via algebraic combining unit 1103 of the two omnidirectional units 1101 and 1102 output signals.

Figure 1:
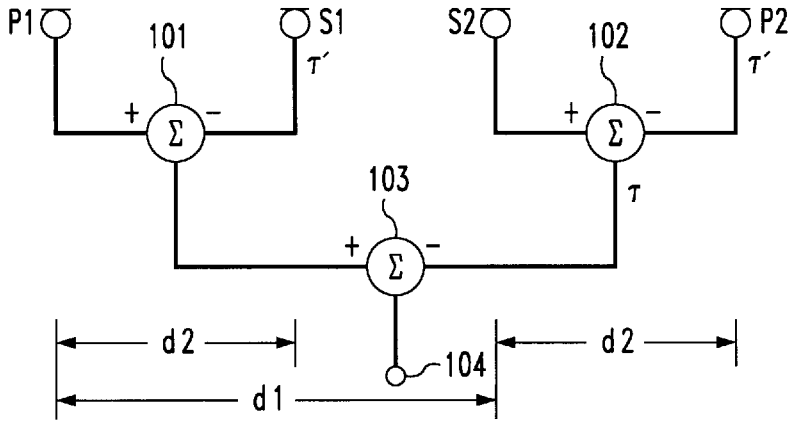
FIG. 1 PRIOR ART
FIG. 1 shows a prior art arrangement for obtaining a SOG microphone assembly which employs electrical delays and electrical subtractions.
Figure 2:
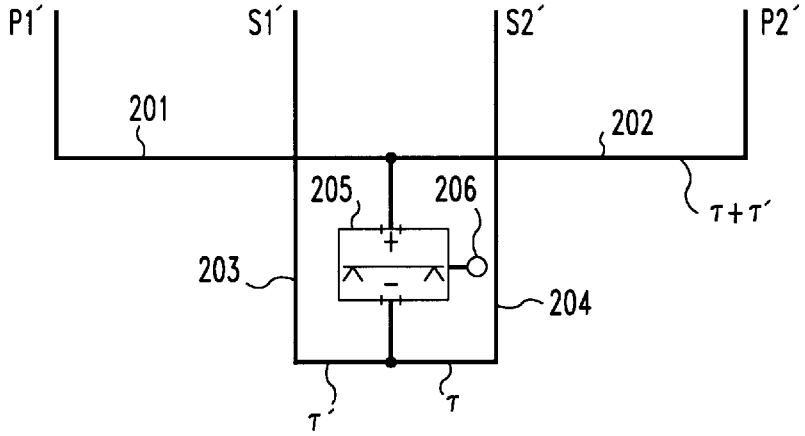
FIG. 2 PRIOR ART
FIG. 2 illustrates another prior art arrangement for obtaining a SOG microphone assembly which employs acoustic delays and acoustic subtractions.
Figure 12:
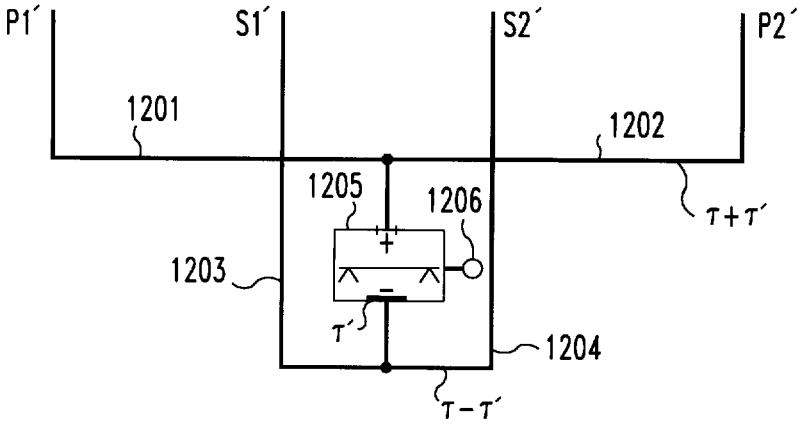
FIG. 12 shows another SOG microphone assembly employing another embodiment of the invention.

FIG. 12 shows another embodiment of the invention that employs a unidirectional (cardioid) microphone element 1205 as opposed to a bidirectional type of microphone element shown in FIG. 2. The unidirectional element 1205 includes an acoustic resistance, yielding delay $\tau'$, just inside its sound entrance from acoustic transmission lines 1203 and 1204. Thus, acoustic transmission line 1203 requires no delay, and acoustic transmission line 1204 requires delay $\tau-\tau'$ so that the same result is achieved as for the embodiment of FIG. 2.

The embodiments of the invention have been described in a far field directional microphone assembly, but the inventive concept can also be used for near field close talking noise canceling microphone assemblies, for example, as frequently used in digital cellular and wireless phones.

What is claimed:

1. A microphone assembly comprising:

a housing having two outer input ports and an inner input port for admission of acoustic energy, the two outer input ports and the inner input port being arranged in predetermined spatial relationship to each other;

at least one microphone element housed in the housing;

at first acoustic transmission line, of a first predetermined length, for transporting acoustic energy entering one of the two outer input ports to a first position on the at least one microphone element;

a second acoustic transmission line, of a second predetermined length, for transporting acoustic energy entering the other of the two outer input ports to the first position on the at least one microphone element;

a third acoustic transmission line, of a third predetermined length, for transporting acoustic energy entering the inner input port to a second position on the at least one microphone element; and a plurality of acoustic resistance elements, at least one acoustic resistance element being positioned in each of the acoustic transmission lines and the at least one acoustic resistance element being matched in specific acoustic resistance to the specific acoustic characteristic resistance of the respective acoustic transmission line.

2. The microphone assembly as defined in claim 1 wherein the acoustic signals from the first and second acoustic transmission lines supplied to the first position on the microphone element and the acoustic signals from the third acoustic transmission line supplied to the second position on the microphone element are acoustically subtracted.

3. The microphone assembly as defined in claim 1 wherein the microphone element is a bidirectional first order gradient microphone element.

4. The microphone assembly as defined in claim 1 wherein the microphone element is a unidirectional first order gradient microphone element.

5. The microphone assembly as defined in claim 1 wherein the microphone element comprises two omnidirectional microphone elements each of said elements yielding an electrical output and algebraic subtraction means for algebraically subtracting the electrical outputs.

6. The microphone assembly as defined in claim 1 wherein the acoustic resistance elements are formed by employing a quasi-continuous material which acts as a distributed acoustic material.

7. The apparatus as defined in claim 1 wherein the acoustic resistance elements are formed by employing an element having relatively small triangular holes therein which acts as a lumped acoustic element.

8. The microphone assembly as defined in claim 1 wherein the acoustic resistance elements are positioned at the input ports of each of the acoustic transmission lines.

9. The apparatus as defined in claim 1 further including one additional inner input port for admission of acoustic energy and a fourth acoustic transmission line of a fourth predetermined length for transporting acoustic energy from the one additional inner input port to the second position on the at least one microphone element.

10. The microphone assembly as defined in claim 9 wherein the acoustic resistance elements are positioned at the input ports of each of the acoustic transmission lines.

11. The microphone assembly as defined in claim 9 wherein the acoustic signals from the first and second acoustic transmission lines supplied to the first position on the microphone element and the acoustic signals from the third and fourth transmission lines supplied to the second position on the microphone element are acoustically subtracted.

12. The apparatus as defined in claim 9 wherein an acoustic resistance element is placed in the fourth acoustic transmission line and is matched thereto.

13. The apparatus as defined in claim 9 wherein the outer input ports and the inner input ports are arranged in colinear spatial relationship to each other.

14. The apparatus as defined in claim 9 wherein the outer input ports and the inner input ports are arranged in non-colinear spatial relationship to each other.

15. The microphone assembly as defined in claim 9 wherein the microphone element is a bidirectional first order gradient microphone element.

16. The microphone assembly as defined in claim 9 wherein the microphone element is a unidirectional first order gradient microphone element.

17. The microphone assembly as defined in claim 9 wherein the microphone element comprises two omnidirectional microphone elements, each of said elements yielding an electrical output and algebraic subtraction means for algebraically subtracting the electrical outputs.

18. The microphone assembly as defined in claim 9 wherein the acoustic resistance elements are formed by employing a quasi-continuous material which acts as a distributed acoustic material.

19. The apparatus as defined in claim 9 wherein the acoustic resistance elements are formed by employing an element having relatively small triangular holes therein which acts as a lumped acoustic element.

* * * * *